United States Patent [19]

Rowlandson et al.

[11] 4,104,114

[45] Aug. 1, 1978

[54] BLEACH PLANT OPERATION

[75] Inventors: Gordon Rowlandson, Birmingham, Ala.; Douglas W. Reeve, Orton; W. Howard Rapson, Scarborough, both of Canada

[73] Assignee: Erco Envirotech Ltd., Islington, Canada

[21] Appl. No.: 794,240

[22] Filed: May 5, 1977

[51] Int. Cl.[2] ..... D21C 3/18

[52] U.S. Cl. ..... 162/29; 162/30 K; 162/48; 162/60; 162/62; 162/68; 162/89

[58] Field of Search ..... 162/60, 88, 89, 61, 162/62, 29, 30 K, 48, 68

[56] References Cited

U.S. PATENT DOCUMENTS

| | | | |
|---|---|---|---|
| 4,000,033 | 12/1976 | Nicolle et al. | 162/29 |
| 4,039,372 | 8/1977 | Reeve et al. | 162/89 |

*Primary Examiner*—S. Leon Bashore
*Assistant Examiner*—William F. Smith
*Attorney, Agent, or Firm*—Sim & McBurney

[57] ABSTRACT

A pulp mill bleach plant operation having a low effluent volume, a low consumption of water, energy and chemicals, and yet provides efficient bleaching, caustic extraction and washing is described. Water conservation is practised by controlling the use of wash water in the bleach plant, controlling the design and operation of washers, deckers and other mechanical devices used in the bleach plant and controlling the inflow of water with chemicals. An aqueous polluting effluent-free pulp mill water utilization system is also described.

16 Claims, 3 Drawing Figures

BLEACH DECKER
STORAGE
BLEACHED DECKER SEAL TANK
SCREENS & CLEANERS
SEAL TANK
MIXER
SENSOR
BLEACH
DECKER
DECKER SEAL TANK
SCREENS AND CLEAN-ERS
SPILL TANK

BLEACH PLANT OPERATION

FIELD OF INVENTION

This invention relates to a pulp mill bleach plant, and in particular, relates to a bleach plant construction and operation for use in a liquid effluent free bleached pulp mill.

BACKGROUND OF THE INVENTION

In a liquid effluent free bleached pulp mill, in which bleached pulp is formed by digesting cellulosic fibrous material and bleaching and purifying the pulp and in which spent pulping liquors are subjected to recovery and regeneration to form fresh pulping liquor, liquid effluents from the bleaching and purification operations (bleach plant effluent) are discharged into the recovery and regeneration operation.

The organic materials content of the bleach plant effluent is burned off in the recovery furnace of the recovery and regeneration operation and the aqueous phase is evaporated in the recovery and regeneration operation.

Owing to the high cost of evaporating water in a pulp mill, in the interests of minimizing operating costs, it is desirable to decrease the total volume of bleach plant effluent which must be discharged into the pulp mill recovery and regeneration operation and hence minimize the total evaporation load. It is also desirable that any bleach plant effluent volume decrease not significantly adversely affect the pulp quality obtained.

SUMMARY AND GENERAL DESCRIPTION OF INVENTION

In accordance with the present invention, there is provided a bleach plant operation in which water conservation is practised by controlling the use of wash water in the bleach plant, controlling the design and operation of washers, deckers and other mechanical devices used in the bleach plant, and controlling the inflow of water with chemicals.

The invention is particularly applicable to a bleach plant operation using a D/CEDED sequence, in which D/C means bleaching with an aqueous solution of chlorine dioxide and chlorine wherein the chlorine dioxide provides the majority of the available chlorine of the solution, D means bleaching with an aqueous solution of chlorine dioxide and E means caustic extraction with aqueous sodium hydroxide solution.

The bleach plant operation of the invention produces two liquid effluents from the bleach plant, one acid and the other alkaline. These effluents then pass to the recovery operation, preferably in accordance with the teachings of copending U.S. application Ser. No. 665,240 filed Mar. 9, 1976, entitled "Bleach Plant Filtrate Recovery," Douglas W. Reeve et al. (J32) now U.S. Pat. No. 4,039,372 and assigned to the assignee of this application.

DESCRIPTION OF PREFERRED EMBODIMENTS

Figure 1:
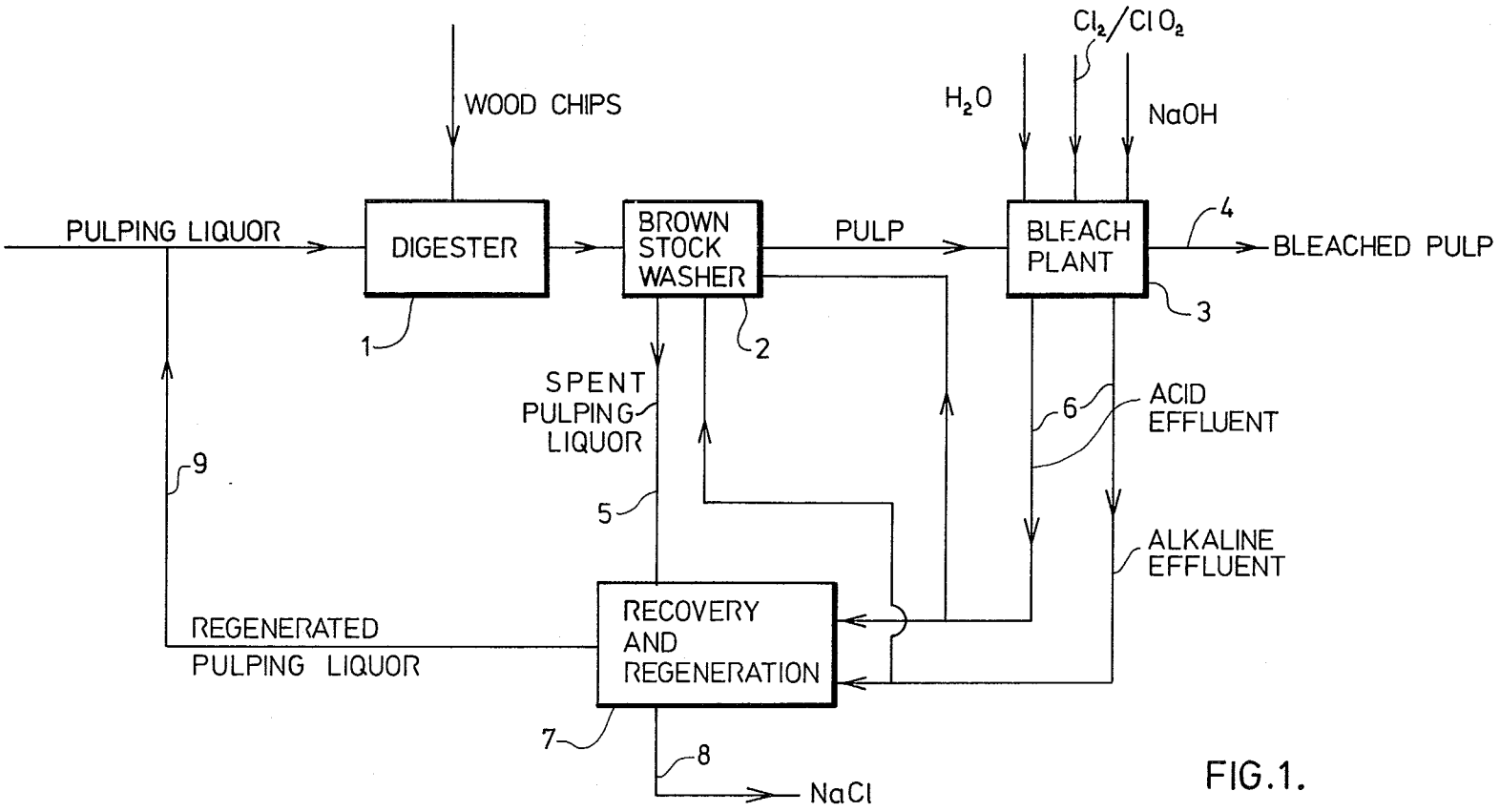
FIG. 1 is a schematic flow sheet of a liquid effluent free pulp mill.

Referring first to FIG. 1, wood chips are digested in pulping liquor in a digester 1 and pass to a brown stock washer 2 wherein the pulp is freed from entrained pulping liquor. The pulp then passes to the bleach plant 3 for bleaching and purification with intermediate washing operations, using chlorine dioxide and chlorine, chlorine dioxide and sodium hydroxide solutions and water, and bleached pulp is recovered by line 4.

Spent pulping liquor from the brown stock washer 2 in line 5 and two aqueous effluents from the bleach plant 3 in line 6 pass to a recovery and regeneration operation 7 wherein combustible organic materials are combusted, pulping liquor is regenerated and sodium chloride, arising from the sodium atoms and the chlorine atoms in the bleach plant effluents, is removed by line 8 to prevent its build up in the system. Regenerated pulping liquor is recycled to the digester 1 by line 9.

In the aqueous effluent-free pulp mill as illustrated in FIG. 1, noxious aqueous effluents from the pulp mill are eliminated by discharge of the bleach plant effluents into the recovery and regeneration operation 7. The organic materials content of the bleach plant effluent is burned off in the recovery furnace of the recovery and regeneration operation 7 while the aqueous phase is evaporated.

Figure 2:
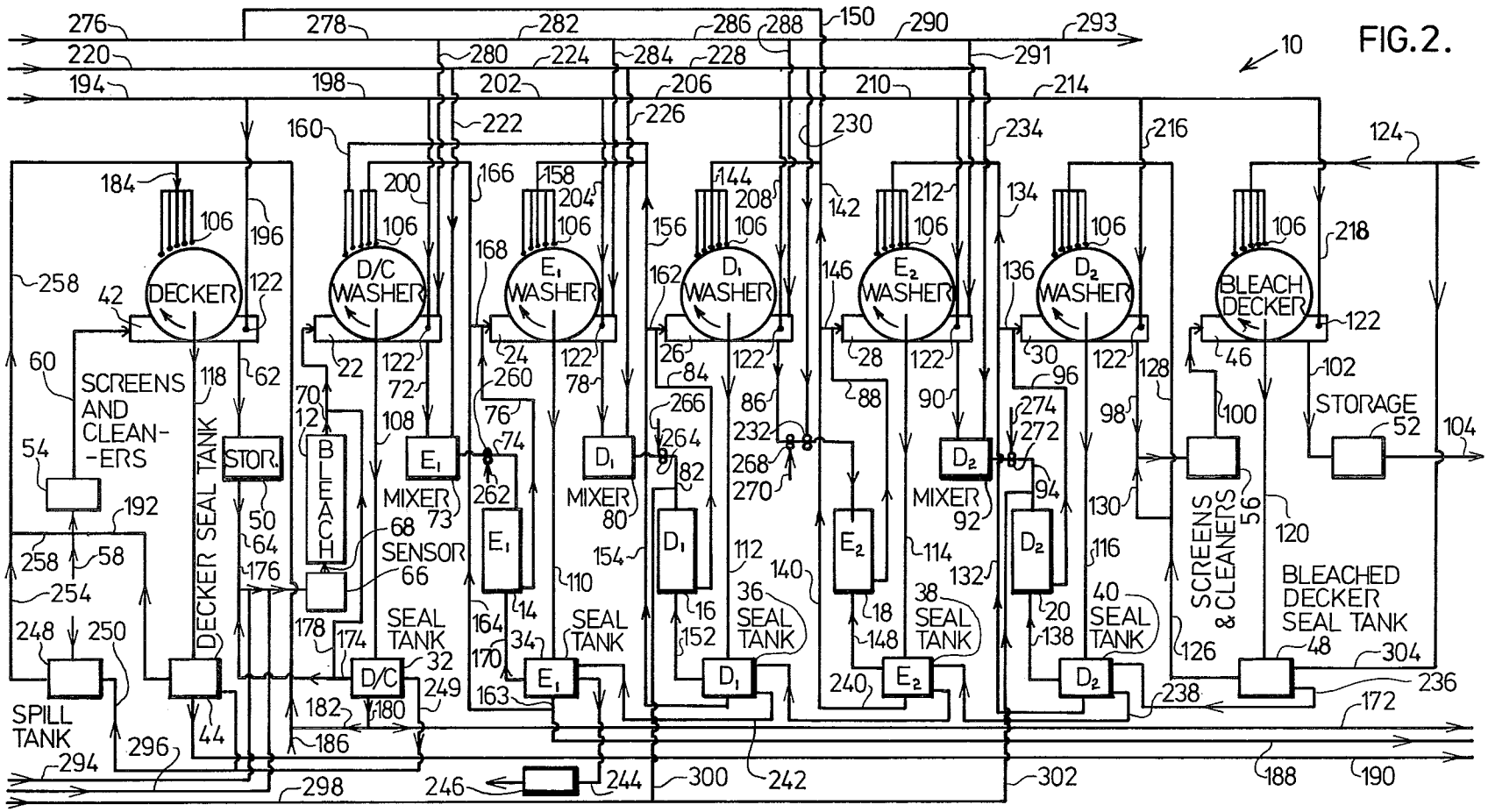
FIG. 2 is a schematic flow sheet of a bleach plant in accordance with one embodiment of the invention.

In FIG. 2, there is illustrated a detailed flow sheet which includes a bleach plant 3 constructed and operated in accordance with the present invention for use in the effluent-free pulp mill illustrated in FIG. 1.

Referring to FIG. 2, a pulp treatment operation 10, incorporating a bleach plant designed to use a D/CEDED bleaching and caustic extraction sequence, includes a D/C bleaching tower 12, an $E_1$ caustic extraction tower 14, a $D_1$ bleaching tower 16, an $E_2$ caustic extraction tower 18 and a $D_2$ bleaching tower 20.

Drum washers are provided for each bleaching and caustic extraction stage including a D/C washer 22, an $E_1$ washer 24, a $D_1$ washer 26, an $E_2$ washer 28 and $D_2$ washer 30. Seal tanks are associated with each of the washers, including a D/C seal tank 32, an $E_1$ seal tank 34, a $D_1$ seal tank 36, an $E_2$ seal tank 38 and a $D_2$ seal tank 40.

An unbleached decker 42 in the form of a displacement washer is provided along with an associated seal tank 44. A similar bleached decker 46 is provided with an associated seal tank 48. Unbleached pulp and bleached pulp storage towers 50 and 52 respectively are provided. Screens and cleaners 54 and 56 are provided for unbleached pulp and bleached pulp respectively.

Unbleached pulp from the brown stock washing is passed by line 58 through the screens and cleaners 54 and via line 60 to the unbleached decker 42 and thence by line 62 to the storage tank 50. The pulp is passed from the storage tank 50 by line 64 to a sensor 66 which senses chlorine dioxide and chlorine required by the pulp. From the sensor the pulp passes by line 68 to the D/C bleaching tower 12.

After D/C bleaching, the pulp passes by line 70 to the D/C washer 22. From the D/C washer the pulp passes by line 72 through an $E_1$ mixer 73 and by line 74 to the $E_1$ extraction tower 14. The pulp passes from the $E_1$ tower 14 by line 76 to the $E_1$ washer 24 and thence by line 78 to a $D_1$ mixer 80 and by line 82 to the $D_1$ bleaching tower 16.

Following $D_1$ bleaching, the pulp next passes by line 84 to the $D_1$ washer 26 and by line 86 to the $E_2$ extraction tower 18. From $E_2$ extraction, the pulp passes by line 88 to the $E_2$ washer 28, by line 90 to a $D_2$ mixer 92 and by line 94 to the $D_2$ bleaching tower 20.

The pulp next passes by line 96 to the $D_2$ washer 30 before passage by line 98 to the screens and cleaners 56, by line 100 to the bleached decker 46 and by line 102 to bleached pulp storage 52. From the bleached pulp storage 52 the pulp is passed forward by line 104, such as, to a pulp drying machine, not shown.

Each of the washers 22, 24, 26, 28 and 30 and each of the deckers 42 and 46 is a rotating foraminous drum type having wash water shower bars 106 arranged adjacent the periphery thereof for the application of wash water to the pulp mat as it is transported on the drum surface, the water displaced from or passing through the mat passing to the appropriate seal tank by lines 108, 110, 112, 114, 116, 118 and 120 respectively. Wire cleaners 122 also are provided for each of the washers and deckers.

A complete countercurrent flow wash water system is utilized. Thus, fresh water passes to the pulp drying machine and pulp drying machine white water or other relatively fresh water is passed by line 124 to the showers 106 on the bleached decker 46 to displacement wash the pulp mat on the bleached decker. Part of the displaced liquor collected in the seal tank 48 is passed by lines 126 and 128 to the showers 106 of the $D_2$ washer 30, with the remainder passing by lines 126 and 130 for dilution of the pulp in line 98 before passage of the diluted pulp to the screens and cleaners 56.

Part of the liquor collected in the $D_2$ seal tank 40 passes by lines 132 and 134 to the washing showers 106 on the $E_2$ washer 28. Part of this liquor passes by lines 132 and 136 to pulp passing from the $D_2$ bleaching tower 20 to the $D_2$ washer 30 in line 96. Part of the collected liquor passes from the seal tank 40 by line 138 to the $D_2$ bleaching tower 20.

The liquor collected in the $E_2$ seal tank 38 partially passes by lines 140, 142 and 144 to the washing shower 106 of the $D_1$ washer 26. Another portion of this liquor passes by lines 140 and 146 to the pulp passing in line 88 from the $E_2$ extraction tower 18 to the $E_2$ washer 28. Further quantities of the collected liquor pass by line 148 to the $E_2$ extraction tower 18.

A small quantity of the liquor collected in the $E_2$ seal tank is used to dilute caustic extraction chemical and is passed to the caustic extraction chemical inlet feed line for this purpose by lines 140, 142 and 150.

The $D_1$ seal tank liquor is partially passed by line 152 to the $D_1$ bleaching tower 16. A portion of the liquor passes by lines 154, 156 and 158 to the showers 106 on the $E_1$ washer 24, while another portion of the liquor passes by lines 154, 156 and 160 to the first showers 106 on the D/C washer 22. Part of the $D_1$ seal tank liquor passes by lines 154 and 162 to the pulp in line 84 passing from the $D_1$ bleaching tower to the $D_1$ washer 26.

From the $E_1$ seal tank 34, part of the liquor passes by lines 163, 164 and 166 to the last showers 106 on the D/C washer 22 while another part passes by lines 163, 164 and 168 to the pulp passing in line 76 from the $E_1$ extraction tower 14 to the $E_1$ washer 24. Another part passes by line 170 to the $E_1$ extraction tower 14 while the remainder is discharged from the bleach plant by lines 163 and 172 for passage to the pulp mill recovery system.

Liquor from the D/C seal tank 32 partly passes by lines 174 and 176 to dilute the pulp passing by line 64 from the storage 50 to the sensor 66 with another part passing by lines 174 and 178 to the pulp passing by line 70 from the D/C bleaching tower 12 to the D/C washer 22. Another part of the liquor is passed by lines 180, 182 and 184 to the showers 106 of the unbleached decker 42. The liquor passing in this way of the showers 106 of the unbleached decker 42 is neutralized by sodium hydroxide solution fed by line 186. The remainder of the liquor passes out of the bleach plant 10 by line 188 for passage to the pulp mill recovery system.

The bleach plant effluents in lines 172 and 188 and the unbleached decker seal tank liquor in line 190 may be utilized as described in the aforementioned copending U.S. application Ser. No. 665,240 filed Mar. 9, 1976.

From the unbleached decker seal tank 44 liquor passes by line 190 for use as wash water in the brown stock washer of the pulp mill and liquor passes by line 192 to the unbleached pulp entering the unbleached screens and cleaners 54 by line 58.

It will be seen, therefore, that there is a general countercurrent flow of wash water and pulp through the pulp treatment operation 10.

Each of the cleaner showers 122 on the washers and deckers is fed by hot water. An inlet feed in line 194 feeds the cleaner 122 on the decker 42 by line 196, the cleaner 122 on the D/C washer 22 by lines 198 and 200, the cleaner 122 on the $E_1$ washer 24 by lines 198, 202 and 204, the cleaner 122 on the $D_1$ washer 26 by lines 198, 202, 206 and 208 the cleaner 122 on the $E_2$ washer 28 by lines 198, 202, 206, 210 and 212, the cleaner 122 on the $D_2$ washer 30 by lines 198, 202, 206, 210, 214 and 216 and the cleaner 122 on the bleached decker 46 by lines 198, 202, 206, 210 214 and 218.

Steam for heating purposes also is used. Thus, steam is fed by lines 220 and 222 to the $E_1$ mixer 72, by lines 220, 224 and 226 to the $D_1$ mixer 80, by lines 220, 224, 228 and 230 to an injection ring 232, and by lines 220, 224, 228 and 234 to the $D_2$ mixer 92.

To accommodate emergency overflow conditions, the seal tanks are connected in a countercurrent flow overflow arrangement. Thus, overflow from the bleached decker seal tank 48 passes by line 236 to the $D_2$ seal tank 40, the overflow from the $D_2$ seal tank 40 passes by line 238 to the $E_2$ seal tank 38, the overflow from the $E_2$ seal tank 38 passes by line 240 to the $D_1$ seal tank 36 and the overflow from the $D_1$ seal tank 36 passes by line 242 to the $E_1$ seal tank 34.

From the $E_1$ seal tank 34, the overflow passes by line 244 to a first spill storage tank 246 while overflow from the D/C seal tank 32 and the unbleached decker seal tank 44 pass to a second spill tank 248 by lines 249 and 250 and lines 252 and 250 respectively.

The overflow collected in the second spill tank 248 under emergency conditions may be returned to the system, after neutralization with sodium hydroxide solution, at a convenient time by lines 254, 256 and 258 while the overflow collected in the first spill tank 246 passes to the recovery system for use in brown stock washing or white liquor dilution.

With this seal tank overflow arrangement, when there is a temporary discharge of a pulp mat of lower than normal consistency from one washer to another, the excess water is returned to the preceding stage by seal tank overflow.

High density pumps are used for pumping the pulp through the bleach plant and such pumps use water-fed seal glands. Hot water fed from line 194 is used for such seal glands. Thus, seal glands of a pump 260 conveying the pulp by line 74 are fed by hot water in line 262, seal glands of a pump 264 conveying the pulp by line 82 are fed by hot water in line 266, seal glands of a pump 268 conveying the pulp by line 86 are fed by hot water in line 270, and seal glands of a pump 272 conveying the pulp by line 94 are fed by hot water in line 274. The pressure on the pump glands is controlled to minimize the flow of fresh water into the pulp passing through the pump.

Chemical feed for the bleaching and caustic extraction operations is provided by dilute sodium hydroxide solution, aqueous solutions of chlorine dioxide and chlorine and sodium hypochlorite solution. Sodium hydroxide solution in concentrated form (typically 50% by wt.) is fed by line 276 to the system and is diluted by the $E_2$ seal tank liquor in line 140 to the concentration required. The diluted sodium hydroxide solution then is passed by lines 278 and 280 to the pulp leaving the D/C washer 22. Sodium hydroxide solution also is passed by lines 278, 282 and 284 to the pulp leaving the $E_1$ washer 24 by lines 278, 282, 286 and 288 to the pulp leaving the $D_1$ washer 26, lines 278, 282, 286, 290 and 291 to the pulp leaving the $E_2$ washer 28. Dilute sodium hydroxide solution also passes by line 292 to the sodium hydroxide neutralization feed 186, provision also being made for emergency flow to the second spill tank 248 in line 293.

An aqueous solution of chlorine dioxide and chlorine is fed by line 294 to the pulp passing by line 64 from the pulp to storage 50 to the sensor 66. Sodium hypochlorite solution is fed by line 296 to the pulp in line 64.

An aqueous chlorine dioxide solution is fed by lines 298 and 300 to the pulp in line 82 before passage thereof into the $D_1$ bleaching tower 16. A mixer, not shown, is located immediately after the injection point of the chlorine dioxide solution to ensure even mixing of the solution with the pulp.

Chlorine dioxide solution is also fed by lines 298 and 302 to the pulp in line 94 before passage thereof into the $D_2$ bleaching tower 20. A mixer, not shown, is located immediately after the injection point of the chlorine dioxide solution to ensure even mixing of the solution with the pulp.

The chlorine dioxide solution fed by line 298 is one having a low concentration of dissolved chlorine whereby over 90% of the available chlorine content of the chlorine dioxide solution is provided by chlorine dioxide. A typical solution is one having a chlorine dioxide concentration of 10 gpl and chlorine concentration of 2 gpl.

The chlorine dioxide and chlorine solution fed by line 294 is one having a higher dissolved chlorine concentration than the chlorine dioxide solution in line 298, whereby about 70% of the available chlorine content of the solution is provided by chlorine dioxide and the remainder of the available chlorine is provided by the chlorine. A suitable solution contains about 10 gpl $ClO_2$ and about 6 gpl $Cl_2$.

The sodium hypochlorite solution in line 296 breaks down under the acid condition of the pulp in line 64 to produce chlorine for the bleaching of the pulp in the D/C bleaching tower 12.

The chlorine dioxide solution in line 298, the chlorine dioxide and chlorine solution in line 294 and the sodium hypochlorite solution in line 296 all may be produced from a single chlorine dioxide and chlorine generator, for example, using the procedure outlined in U.S. Pat. No. 4,010,112. By the use of the latter chlorine dioxide generation system, the most efficient use of bleaching chemicals is obtained while the volume of water entering the bleach plant with chlorine dioxide and chlorine is minimized.

OPERATION

In operating the pulp mill system described above, steps are taken to ensure optimum bleaching, caustic extraction and washing, minimal consumption of water, energy and chemicals and the discharge of a minimal volume of liquid effluent, in the region of about 4000 U.S. gallons/air dried ton (USG/ADT) of pulp, as compared with the liquid effluent discharge from a conventional bleach plant operation of up to about 25,000 USG/ADT while the bleached pulp produced has properties at least comparable to those of pulp produced in conventional operations.

The fresh water consumption in the bleach plant is very small, with the principal inputs of fresh water to the bleach plant being pulp machine white water, chlorine dioxide solutions and the water in the unbleached pulp. Thus, not only does this bleach plant operation decrease the effluent volume to a level which is suitable for feed to the recovery system, but also decreases fresh water and hot water use from typically 20,000 USG/ADT to a negligible value.

Steam consumption is also decreased considerably from the conventional 5,000 to 7000 lbs/ADT to less than 1000 lbs/ADT, a considerable saving.

In the bleach plant operation, the pulp leaving line 64 is diluted with D/C seal tank filtrate in line 176 to the required consistency, typically about 4%, before mixing with the chlorine dioxide and chlorine solution in line 294, with additional chlorine being supplied by the sodium hypochlorite solution in line 296. In this way, the necessity for conventional chlorine gas injection is eliminated. While the use of sodium hypochlorite solution to provide part of the first stage chlorine requirement raises the pH of the D/C bleaching, it has been found that efficient bleaching chemical utilization is maintained even up to 1% of sodium hypochlorite (determined as available $Cl_2$ on the pulp).

Owing to the heat in the filtrate used in the dilution and arising from the elimination of conventional discharge of unbleached decker filtrate, the pulp fed to the bleaching tower 12 has a temperature of about 120° to 140° F (50° to 60° C). As is well known, pulp chlorination is usually carried out at temperatures less than 90° F (30° C) and higher temperatures increase the rate of reaction of the chlorine with the pulp. To control against overchlorination of the pulp with consequent strength losses, the chlorine dosage to the pulp is controlled in accordance with the sensor 66 which senses the kappa number of the pulp passing therethrough. This control, which may be by an optical or oxidation-reduction potential sensor, also results in no residual chlorine values and effective chemical usage.

The D/C bleaching tower 12 may be a conventional upflow tower having about 30 to 60 minutes retention time or a two-stage upflow-downflow tower with a retention time of about 20 minutes in the upflow and 0 to 25 minutes in the downflow. The variation in retention time achieved by an upflow-downflow tower allows ready compensation for variations in temperature and $\%ClO_2$ substitution.

The substitution of chlorine dioxide for about 70 percent of the chlorine in the first stage bleaching operation is an important feature of the bleach plant operation. Since all the sodium and chlorine atoms in the recovered effluent must be matched, providing part of the oxidizing power with chlorine dioxide decreases the total chlorine atoms and hence the required matching sodium atoms, enabling the overall quantity of sodium hydroxide required to be decreased.

It follows, therefore, that the use of 70/30 D/C bleaching decreases the total quantity of sodium chloride discharged by the recovery system as compared with 100% C. Hence, any detrimental effects which may result from the discharge of sodium chloride containing liquors into the recovery system are decreased.

The use of 70/30 D/C first stage bleaching also produces brighter, stronger pulp with greater stability to yellowing with age as compared with 100% C first stage bleaching and results in an improved yield of bleached pulp.

In each of the other stages, conventional towers are used, operating at conventional temperatures of about 160° F (70° C), while the consistency is about 13%, which is higher than the conventionally achieved value of 10 to 12%.

The use of the $E_2$ seal tank filtrate to dilute the 50% NaOH solution for use in the system results in water and steam savings, the resulting solution being hotter than is usually used. It is also preferred to use a concentration of about 10 to 13% NaOH, which is more concentrated than conventionally used.

In the countercurrent washing operation, the wash water for a given stage is obtained from the seal tank of the following stage. Good washing is required on the $E_1$ washer to minimize the carry over of $E_1$ stage solids which would result in increased chlorine dioxide consumption in the $D_1$ stage. Hence a dilution factor of at least 3 is used in the $E_1$ washer and on all other washers a dilution factor of at least 2 is used.

The showers 106 on each of the washers are placed and oriented for optimum wash water distribution on the pulp mat and hence most efficient washing on each of the washers. The washer size is such as to provide a consistency of at least 13% on each washer for greatest washing efficiency.

The washing on the D/C washer is split between first $D_1$ filtrate and then $E_1$ filtrate with the $E_1$ filtrate application being controlled to about 75% of the water contained in the pulp mat in order to prevent passage of $E_1$ filtrate through the mat and into the D/C filtrate. The presence of $E_1$ filtrate in the D/C filtrate increases chemical consumption in the D/C stage and operation in the described manner avoids this problem.

On each of the washers an air doctor is used in place of a conventional external water-fed hydraulic doctor to remove the pulp mat from the screen after washing, although it may be possible to use a hydraulic doctor which uses filtrate recycled within the particular stage.

The wire cleaning showers 122 which are used in place of conventional hydraulic doctors which also remove the pulp mat from the washer screen are high pressure low volume wire cleaning showers. Each of the wire cleaning showers 122 is timer controlled so that they operate for only a small percentage of the time in order to decrease fresh hot water usage, typically to an overall volume of about 10 USG/min on the D/C and $E_1$ washers and to an overall volume of about 5 USG/min on the $D_1$, $E_2$ and $D_2$ and bleached decker washers. Conventional hydraulic doctors use about 100 USG/min.

The use of hot water on the showers 122 decreases the thermal shock of conventional cold water hydraulic doctors, thereby improving the effective washer life and decreasing the overall steam heating requirement.

The liquid level in the bleached decker seal tank 48 is controlled by the addition of pulp machine white water in line 304 while the levels in the seal tanks 32, 34, 36, 38 and 40 are controlled by level control valves which feed the shower water to the preceding stage, providing a positive control on these levels, in place of the conventional overflow system. The seal tanks only overflow under emergency conditions.

The seal tanks have a tangential drop leg entry. The use of tangential entry releases entrained air and minimizes foaming tendencies. A parallel tangential entry of overflow from the following seal tank may be used to prevent reverse overflow.

The seal tanks are sized to allow sufficient time for entrained air separation, the sizing typically being such as to provide a filtrate retention time of about 120 seconds for the unbleached decker, D/C and $E_1$ seal tanks and of about 60 seconds for the $D_1$, $E_2$, $D_2$ and bleached decker seal tanks. A large freeboard space also is provided in each seal tank to allow for air separation, typically about 8 feet.

Figure 3:
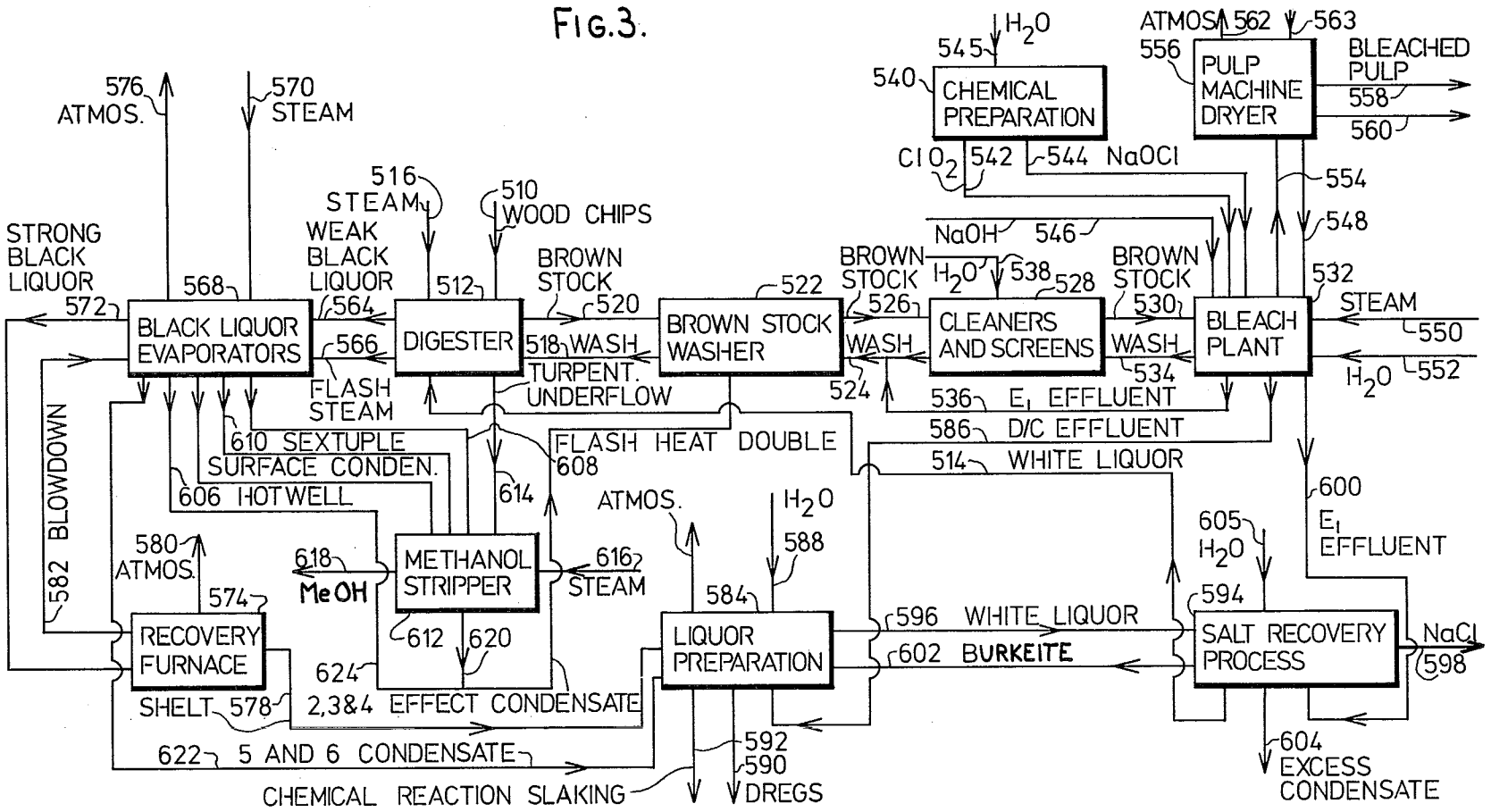
FIG. 3 is a schematic flow sheet of a pulp mill recovery and regeneration operation for use in this invention.

Turning now to consideration of FIG. 3, there is illustrated a bleached kraft pulp mill operation in which the overall material flow within an effluent-free pulp mill is illustrated. With the elimination of the toxic effect of bleach plant effluent by introducing the same to the pulp mill recovery operation, black liquor condensates become the potential dominant effluent. While the total BOD of the black liquor condensates is moderate, typically about 20 lbs of methanol ADT of pulp, when compared with that of bleach plant effluent, within the context of an "effluent-free" pulp mill, the value is quite high.

In the pulp mill operation illustrated in FIG. 3, the BOD level of the black liquor condensates is decreased to a very low level acceptable for discharge from the mill in the "effluent-free" environment. This is achieved by combining the most contaminated condensates and them steam stripping methanol from this mixture. The methanol removed in this way then may be used for its fuel value or otherwise. The stripped condensate then may be used in various locations in the mill.

As seen in FIG. 3, wood chips are fed by line 510 to a digester 512 to which white liquor is fed by line 514 and steaming vessel steam is fed by line 516. Pulp wash water also is fed to the digester 512 by line 518. The brown stock pulp is fed from the digester 512 by line 520 to a brown stock washer 522 to which wash water is fed by line 524. The washed pulp passes by line 526 through cleaners and screens 528 and line 530 to a bleach plant 532, such as that described above in connection with FIG. 2 and including the unbleached decker 42.

Wash water from the bleach plant 532 passes by line 534 to the cleaners and screens 528 and $E_1$ stage effluent from the bleach plant 532 passes by line 536 to join the wash water in line 524 passing to the brown stock washer 522. Wire cleaning water also passes to the cleaners and screens 528 by line 538.

Chlorine chemical preparation 540 provides chlorine dioxide and chlorine solutions to the bleach plant 532 by line 542 and sodium hypochlorite solution by line 544. The chemical preparation is fed by water in line 545 and is typically in accordance with the aforementioned procedure of U.S. Pat. No. 4,010,112.

Sodium hydroxide for the bleach plant 532 is fed by line 546 while wash water in the form of pupl machine dryer white water is fed by line 548 to the bleach plant. Other inputs for the bleach plant 532 are heating steam by line 550 and washer screen cleaner water by line 552.

The bleached pulp passing out of the bleach plant 532 passes by line 554 to the pulp machine dryer 556. Bleached pulp exits the dryer by line 558 while any excess white water not required in line 546 is passed to sewer by line 560, while some moisture passes to atmosphere through the dryer stack 562. Water for a variety of purposes enters to pulp machine dryer 556 by line 563, including vacuum pump seal water, condensate cooler water, trim jet water and steam shower steam.

The dilute black liquor and flash steam from the digester 512 pass by lines 564 and 566 to black liquor evaporators 568. Additional heating steam is fed to the evaporators 568 by line 570. The black liquor evaporators takes the form of sextuple effect evaporators which produce concentrated black liquor which passes by line 572 to the recovery furnace 574. Various other liquid effluents are produced and these will be described further below. Moisture is lost through weak black liquor oxidation stack 576.

In the recovery furnace 574 all the organic materials are burned and there is formed a smelt in line 578 containing sodium carbonate, sodium sulphide, sodium chloride and sodium sulphate. Stack gases are vented by line 580. Steam is generated in the furnace and the blow down is passed by line 582 to the evaporators 568.

The smelt in line 578 then is passed to liquor preparation 584 wherein white liquor is regenerated. D/C effluent from the bleach plant 532 passes by line 586 to liquor preparation 584 for kiln scrubbing therein. Smelt spray water is fed to the liquor preparation 584 by line 588. Solid green liquor dregs are removed from the liquor preparation 584 by line 590 as are dregs from the causticization by line 592.

The white liquor resulting from chemical preparation passes to a salt recovery process 594 by line 596. In the salt recovery process, which typically may be that outlined in U.S. Pat. No. 3,950,217, solid sodium chloride is removed from the white liquor by an evaporative procedure and recovered by line 598. The concentrated white liquor is diluted by $E_1$ filtrate from the bleach plant 532 fed by line 600 to the desired concentration to the digester 512 by line 514, as described in our copending application Ser. No. 665,240 mentioned above.

Burkeite also deposited in the salt recovery process 594 passes by line 602 to the liquor preparation 584, while excess condensate from the salt recovery process 594 is passed to sewer by line 604. Water for salt leaching in the salt recovery process 594 is fed by line 605.

The only liquid effluents being sewered from the system are excess white water in line 560 and excess condensate from the salt recovery process in line 604. Both of these liquors are pure water and hence their discharge is not harmful.

As mentioned above, there are a number of condensates from the black liquor evaporators 568. Those most contaminated with methanol from the black liquor, the hotwell condensate, the flash heat double evaporator condensate and the sextuple surface condenser condensate pass by lines 606, 608 and 610 respectively to a methanol stripper 612 along with turpentine underflow from the digester 512 in line 614. In the methanol stripper 612, steam, fed by line 616, strips methanol from the contaminated condensate. The methanol is recovered by line 618 while the purified condensate passes by line 620 to the brown stock washer 522 for use as wash water therein.

Part or all of the purified condensate may be used in a variety of other locations within the mill, for example, in wire cleaning in the cleaners and screens 528, for chlorine dioxide adsorption in chemical preparation 540, or as wash water in the bleach plant, or by line 621 in the bleach plant of FIG. 2.

The condensate from the fifth and sixth effect evaporators in the black liquor evaporators 568 is passed by line 622 to liquor preparation 584, while condensate from the second, third and fourth effect evaporators being relatively free of contaminants may be discharged or may join with the purified condensate in line 620 by line 624.

SUMMARY

The present invention, therefore, provides a bleach plant process which results in a low efficient volume and yet produces good pulp quality. The present invention also provides a bleached kraft mill water utilization system which eliminates noxious aqueous effluents. Modifications are possible within the scope of the invention.

What we claim is:

1. A bleach plant process including a combination of steps to achieve a low volume of effluent, a low consumption of water, energy and chemicals and efficient bleaching, caustic extraction and washing of cellulosic fibrous material pulp in a D/CEDED sequence, the steps comprising:

(a) passing unbleached pulp sequentially to a D/C bleaching tower for initial bleaching with an aqueous solution of chlorine dioxide and chlorine mixed therewith, to a D/C washer for washing the initially-bleached pulp, to an $E_1$ caustic extraction tower for initial extraction with an aqueous sodium hydroxide solution mixed therewith, to an $E_1$ washer for washing the initially-extracted pulp, to a $D_1$ bleaching tower for further bleaching with an aqueous chlorine dioxide solution mixed therewith, to a $D_1$ washer for washing the further-bleached pulp, to an $E_2$ extraction tower for further extraction with aqueous sodium hydroxide solution mixed therewith, to an $E_2$ washer for washing the further-extracted pulp, to a $D_2$ bleaching tower for final bleaching with an aqueous chlorine dioxide solution mixed therewith, to a $D_2$ washer for washing the finally-bleached pulp, to a bleached pulp decer for final washing of the bleached pulp and to bleached pulp storage;

(b) controlling the quantity of chlorine fed to the initial bleaching operation to minimize overchlorination and strength losses and to result in a substantial absence of residual chlorine in the initially-bleached pulp;

(c) passing filtrate from each of said washers and said bleached decker to a seal tank associated with the respective washer or decker;

(d) removing two effluents from the process consisting of an acid effluent from the D/C seal tank and an alkaline effluent from the $E_1$ seal tank;

(e) providing a countercurrent flow of wash water with respect to the flow of pulp through the bleach plant consisting of passing respectively fresh water to the bleached pulp decker, passing filtrate from the bleached decer seal tank to the $D_2$ washer, passing filtrate from the $D_2$ seal tank to the $E_2$ washer, passing filtrate from the $E_2$ seal tank to the $D_1$ wahser, passing filtrate from the $D_1$ seal tank to the $E_1$ washer and to an initial portion of the washing on the D/C washer, and passing liquor from the $E_1$ seal tank to a latter portion of the washing on the D/C washer while avoiding the presence of $E_1$ seal tank filtrate in the D/C filtrate;

(f) conducting said washing on said $E_1$ washer at a dilution factor of a least about 3 while conducting said washing on said D/C washer, $D_1$ washer, $E_2$ washer, $D_2$ washer and bleached decker washer at a dilution factor of at least about 2;

(g) individually controlling the liquid level in each of said seal tanks below a minimum level except under emergecy conditions by cycling filtrate at a controlled rate from the respective seal tank to the appropriate washer; and (h) connecting the seal tanks in countercurrent overflow arrangement for the accommodation of emergency conditions in which overflow from the bleached decker seal tank passes to the $D_2$ seal tank, overflow from the $D_2$ seal tank passes to the $E_2$ seal tank, overflow from the $E_2$ seal tank passes to the $D_1$ seal tank, overflow from the $D_1$ seal tank passes to the $E_1$ seal tank, overflow from the $E_1$ seal tank passes to a first spill storage tank and overflow from the D/C seal tank passes to a second spill storage tank.

2. The process of claim 1 wherein sodium hypochlorite solution is also used as a source of chlorine in said initial bleaching.

3. The process of claim 1 wherein said aqueuous solution of chlorine dioxide and chlorine has a chlorine dioxide concentration of about 10 gpl and a chlorine concentration of about 6 gpl and said aqueous chlorine dioxide solutions both have a chlorine dioxide concentration of about 10 gpl and a chlorine concentration of about 2 gpl.

4. The process of claim 1 wherein said D/C bleaching is carried out at a temperaure of about 50° to 60° C and said $D_1$ and $D_2$ bleachings and said $E_1$ and $E_2$ extractions are carried out at a temperature of about 70° C.

5. The process of claim 1 wherein said D/C bleaching tower is a two-stage upflow-downflow tower having a retention time of about 20 minutes in the upflow and 0 to 25 minutes in the downflow.

6. The process of claim 1 wherein said aqueous sodium hydroxide solutions have a concentration of about 10 to 13% NaOH.

7. The process of claim 1 wherein said aqueous sodium hydroxide solutions are provided from a single source of relatively concentrated sodium hydroxide solution which is diluted to the desired concentration for said caustic extraction operations by the use of filtrate from the $E_2$ seal tank.

8. The process of claim 1 wherein each of said washers and said bleached decker is a rotating foraminous drum type having wash water shower bars arranged adjacent the periphery thereof for the application of wash water to the pulp mat transported on the drum surface and oriented for optimum wash water distribution on the pulp mat.

9. The process of claim 8 wherein each washer is sized to provide a pulp consistency of at least about 13% on each washer.

10. The process of claim 8 wherein a high pressure and low volume wire cleaning shower is provided for each washer or decker, hot water is passed to said wire cleaning shower, and the cleaning operation of said wire cleaning shower is controlled for intermittent operation only.

11. The process of claim 8 including removing pulp mat from the foraminous drum after completion of said washing by the use of an air doctor or a hydraulic doctor which utilizes filtrate recycled from the respective seal tank.

12. The process of claim 1 including pumping said pulp through the bleach plant using high density pumps having hot water-fed seal glands and controlling the hot water pressure on the seal glands to minimize the flow of such water into the pulp passing through the pump.

13. The process of claim 1 wherein each of said seal tanks has a tangential drop leg entry and is sized to permit entrained air separation.

14. The process of claim 1 wherein overflow collected in said second spill tank is neutralized and returned to the bleach paint.

15. The process of claim 1 including heating said pulp between each washer and subsequent tower by use of steam.

16. The process of claim 1 wherein said unbleached pulp is provided from an unbleached pulp storage tank to which washed pulp is passed from an unbleached decker having an associated seal tank, overflow from the unbleached decker seal tank passes to said second spill tank and washing is effected on said unbleached decker using neutralized filtrate from the D/C seal tank.

* * * * *